US006379853B1

(12) United States Patent
Lin et al.

(10) Patent No.: US 6,379,853 B1
(45) Date of Patent: Apr. 30, 2002

(54) ELECTROPHOTOGRAPHIC IMAGING MEMBER HAVING TWO CHARGE TRANSPORT LAYERS FOR LIMITING TONER CONSUMPTION

(75) Inventors: Liang-bih Lin, Webster; Cindy C. Chen, Rochester; Richard H. Nealey, Penfield; Harold F. Hammond, Webster; Robert W. Nolley, deceased, late of Webster, by Vivian D Nolley; Kenny-Tuan T. Dinh, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,578

(22) Filed: Nov. 28, 2000

(51) Int. Cl.[7] ..... G03G 5/047

(52) U.S. Cl. ..... 430/58.45; 430/58.5; 430/58.55; 430/58.8; 430/125; 430/133

(58) Field of Search ..... 430/58.05, 58.5, 430/58.45, 58.55, 58.8, 133, 125

(56) References Cited

U.S. PATENT DOCUMENTS

| | | | | |
|---|---|---|---|---|
| 3,121,006 A | | 2/1964 | Middleton et al. | |
| 3,870,516 A | | 5/1975 | Smith et al. | |
| 3,972,717 A | | 8/1976 | Wiedemann | |
| 4,265,990 A | | 5/1981 | Stolka et al. | |
| 4,302,521 A | | 11/1981 | Takei et al. | |
| 4,801,517 A | | 1/1989 | Frechet et al. | |
| 4,806,443 A | | 2/1989 | Yanus et al. | |
| 4,807,444 A | | 2/1989 | Aoki et al. | |
| 4,818,650 A | | 4/1989 | Limburg et al. | |
| 4,889,784 A | * | 12/1989 | Champ et al. | 430/58.45 |
| 5,030,532 A | | 7/1991 | Limburg et al. | |
| 5,830,614 A | * | 11/1998 | Pai et al. | 430/58.05 |
| 6,068,960 A | * | 5/2000 | Pai et al. | 430/58.8 |
| 6,127,077 A | | 10/2000 | Pai et al. | |

* cited by examiner

*Primary Examiner*—Christopher Rodee

(57) ABSTRACT

An electrophotographic imaging member including a supporting substrate, an optional charge blocking layer, an optional adhesive layer, a charge generating layer, and a charge transporting element including two sequentially deposited charge transport layers each including a hole transport material and an optional film forming binder. A first charge transport layer exhibits a first charge carrier transit time and second charge transport layer exhibits a second charge carrier transit time. The two charge transport layers are formed in one of two ways. First, each layer can be formed from a different charge transport material so that the charge mobility of the charge transport material of the first charge transport layer is about 4 to about 20 times lower than the charge mobility of the charge transport material of the second charge transport layer. Or, alternatively, each charge transport layer can be made using a different amount of the same charge transport material. In this case, the first charge transport layer includes of an amount of charge transport material that is about 5% to about 30% less than an amount of charge transport material used to form the second charge transport layer. In either case, the resulting electrophotographic imaging member exhibits a discharge surface potential at a light exposure greater than about 3 erg/cm$^2$, at a post exposure delay between about 20 milliseconds and about 500 milliseconds that can be raised from about 20 to about 200 volts above a discharge potential of an imaging member having the same components as the imaging member of the present invention except having only a single charge transport layer with a thickness that is equivalent to the charge transporting element of the present invention.

12 Claims, No Drawings

ELECTROPHOTOGRAPHIC IMAGING MEMBER HAVING TWO CHARGE TRANSPORT LAYERS FOR LIMITING TONER CONSUMPTION

BACKGROUND OF THE INVENTION

1. Field of Invention

This invention relates in general to electrophotography, and more specifically, to electrophotographic imaging members comprising two charge transport layers, processes for fabricating such members, and use of such members to limit toner consumption due to excess toner deposition.

2. Description of Related Art

Electrophotographic imaging members (i.e. photoreceptors) are well known. Typical electrophotographic imaging members are commonly used in electrophotographic (xerographic) processes in either a flexible belt or a rigid drum configuration. These electrophotographic imaging members comprise a photoconductive layer comprising a single layer or composite layers. One type of composite photoconductive layer used in xerography is illustrated in U.S. Pat. No. 4,265,990, which describes a photosensitive member having at least two electrically operative layers. One layer comprises a photoconductive or charge generating layer that is capable of photogenerating holes and injecting the photogenerated holes into a contiguous charge transport layer. Generally, where the two electrically operative layers are supported on a conductive layer, the charge generating layer is sandwiched between a contiguous charge transport layer and the supporting conductive layer. Alternatively, the charge transport layer may be sandwiched between the supporting electrode and a charge generating layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper or to an intermediate transfer member that thereafter transfers the image to a member such as paper.

One problem with prior art photoreceptors relates to photoinduced discharge curve (PIDC) characteristics of the photoreceptors. The expression "photoinduced discharged curve" (PIDC), as employed herein, is defined as a relationship between the potential as a function of exposure and a measure of the sensitivity of the device. It generally represents the supply efficiency (number carriers injected from the generator layer into the transport layer per incident photon) as a function of the field across the device. More specifically, when the $V_{low}$, voltage at a high light exposure, is below a predetermined value, the imaging system consumes toner too rapidly, resulting in early failure of the imaging system. This is due to excess deposition of toner in the image areas to form very dense layers. $V_{low}$, is related to $V_{residual}$. The combination of electrical bias and $V_{low}$ results in overtoning during electrostatic latent image development to form toner images that are too dense, i.e., the electrical development field is too large. "$V_{low}$", as employed herein, is defined as the surface potential of a PIDC at a high intensity light exposure of, e.g., about 2.5–15 ergs/cm$^2$. "$V_{residual}$", as employed herein, is defined as the surface potential of a PIDC at a given light exposure (e.g., about 25–300 ergs/cm$^2$), that is significantly higher (e.g., about 10 times higher) than the exposure leading to $V_{low}$. Cyclic stability is important and $V_{residual}$ and $V_{low}$ can increase with cycling due to persistently trapped charges. $V_{low}$ approaches $V_{residual}$ in an infinite amount of time. Thus, it is desirable to raise $V_{low}$ in a controlled fashion to a desirable value, which can be maintained under repeated use, and preferably without significantly altering the initial and low exposure photosensitivity. In other words, a more tunable photoreceptor is desirable.

Tunable photoreceptors, due to their tunable photosensitivity characteristics, have the advantage of being applicable to many different xerographic machines, including printers, copiers, duplicators, facsimile machines, multifunctional machines, and the like. With dual photoconductive components in a charge generating layer, a high sensitivity pigment such as hydroxygallium phthalocyanine and a low sensitivity pigment such as alkylhydroxygallium phthalocyanine, the initial photosensitivity can be adjusted within a range corresponding to the loading ratio of each component. However, it is often difficult to match both high field and low field photoinduced discharge curves ($V_{low}$ PIDC) by merely adjusting the charge generating layer composition. $V_{low}$ is related to charge generation and transport and can be adjusted by photogeneration and charge transport efficiencies. $V_{low}$, is a critical parameter to toner consumption and is difficult to adjust by merely varying the composition of a charge generation layer. For example, a multilayered photoreceptor comprising a charge generating layer of chlorogallium phthalocyanine dispersed in a film forming binder and a charge transport layer comprising an arylamine charge transport material in a film forming binder has a low $V_{low}$, and attempts to raise $V_{low}$ by lowering the photogeneration efficiency by changing the charge generating layer composition are not sufficient because they may also change the initial photosensitivity to some undesirable value.

U.S. Pat. No. 6,068,960 discloses a photoreceptor fabrication method including depositing a charge generating layer, depositing a first charge transport layer having a first charge carrier mobility value and depositing a second charge transport layer having a second charge carrier mobility value that is different from the first charge carrier mobility value. These steps can occur in any order and the difference in the first charge carrier mobility value and the second charge carrier mobility value is accomplished by including a first binder and a first charge transport material in a first charge transport layer and a second binder and a second charge transport material in a second charge transport layer. The first binder is selected to have a lower solubility limit for the first charge transport material than the solubility limit of the second binder for the second charge transport material. Or alternatively, a first polymeric compound composed of a first charge transport moiety covalently bonded to a first binder moiety is selected for a first transport layer and a second polymeric compound composed of a second charge transport moiety covalently bonded to a second binder moiety in a second transport layer, and selecting the proportion of the first charge transport moiety in the first polymeric compound to be less than the proportion of the second charge transport moiety in the second polymeric compound.

U.S. patent application Ser. No. 09/152,972, now U.S. Pat. No. 6,127,077 entitled "Photoreceptors With Delayed Discharge" filed Sep. 14, 1998, discloses a photoreceptor having a substrate, including: (a) a charge generating layer; (b) a first charge transport layer having a first charge carrier mobility value; and (c) a second charge transport layer having a second charge carrier mobility value. The first charge transport layer is closer to the charge generating layer than the second charge transport layer and the second charge transport layer is contiguous to the first charge transport layer. Also, the second charge carrier mobility value is higher than the first charge carrier mobility value.

The entire disclosures of each of the above cited patents and patent applications are incorporated herein by reference in their entireties.

While the above mentioned treatment techniques may be suitable for their intended purposes, there continues to be a need for an improved photoreceptor in which $V_{low}$ can be flexibly raised without significant changes to the other parts of PIDC, especially the initial and low exposure photosensitivities.

SUMMARY OF THE INVENTION

It is, therefore, an object of the present invention to provide an improved photoreceptor having a $V_{low}$ that can be flexibly raised to some desirable value without substantially altering the initial and low light exposure photosensitivity.

It is another object of the present invention to provide an improved photoreceptor that uses toner at a lower rate.

It is still another object of the present invention to provide an improved photoreceptor that prevents overtoning during development.

It is yet another object of the present invention to provide an improved photoreceptor that exhibits greater cyclic stability even at relatively high $V_{low}$.

It is another object of the present invention to provide an improved photoreceptor that can be manufactured with greater flexibility in achieving a wide range of different photoelectrical properties, mainly in PIDC.

These objects are achieved by the present invention by providing an electrophotographic imaging member comprising a charge transport element including two sequentially deposited charge transport layers; wherein each transport layer comprises a hole transport material and optionally a film forming binder; wherein a first charge transport layer exhibits a first charge carrier transit time and second charge transport layer exhibits and a second charge carrier transit time. Further, the charge transporting member of the present invention is fabricated in one of two ways. First, a different charge transport material can be used for each charge transport layer so that the charge mobility of the charge transport material of the first charge transport layer is 4 to 20 times lower than the charge mobility of the charge transport material of the second charge transport layer. Or, both charge transport layers can be comprised of the same charge transport material. In this case, the first charge transport layer is comprised of about 5% to about 30% more charge transport material than an amount of charge transport material comprised by the second charge transport layer. In either case, the resulting imaging member exhibits a discharge surface potential at a light exposure greater than about 3 erg/cm$^2$ at a post exposure delay of between about 20 milliseconds and about 500 milliseconds that is raised from about 20 to about 200 volts above a discharge potential of an imaging member comprising the same components as those used in the imaging member of the present invention except having a single charge transport layer with a thickness that is equivalent to the thickness of the dual layer charge transporting element of the present invention.

DETAILED DESCRIPTION OF PREFERRED EMBODIMENTS

The foregoing objects and others are accomplished in accordance with the present invention by providing an electrophotographic imaging member comprising a substrate, a charge generating layer, and charge transporting element comprising two charge transport layers each comprising a hole transport material and a film forming binder.

$V_{low}$ can be flexibly raised to a predetermined desired value without substantially altering the initial and low light exposure photosensitivities by more than about 15 percent of their original values. The initial and low light exposure photosensitivities are defined by $(dV/dX)X=0$ being the derivative of surface potential versus exposure at zero light exposure, and $E_{0.1}$ and $E_{0.2}$ being the amounts of radiation necessary to discharge an electrophotographic imaging member about 10 percent and about 20 percent, respectively, of the original surface potential on the electrophotographic imaging member.

Electrophotographic imaging members (photoreceptors) are well known in the art. The electrophotographic imaging member of the present invention can be prepared by any suitable technique. Typically, a flexible or rigid substrate is provided with an electrically conductive surface. A charge generating layer is then applied to the electrically conductive surface. A charge blocking layer can optionally be applied to the electrically conductive surface prior to the application of a charge generating layer. If desired, an adhesive layer can be used between the charge blocking layer and the charge generating layer. Usually the charge generation layer is applied onto the blocking layer and a charge transport layer is formed on the charge generation layer. This structure can have the charge generation layer on top of or below the charge transport layer.

The substrate can be opaque or substantially transparent and may comprise any suitable material having the required mechanical properties. Accordingly, the substrate can comprise a layer of an electrically non-conductive or conductive material such as an inorganic or an organic composition. Various known resins can be used as electrically non-conducting materials including, but not limited to, polyesters, polycarbonates, polyamides, polyurethanes, and the like that are flexible as thin webs. An electrically conducting substrate can be any metal, including but not limited to, aluminum, nickel, steel, copper, and the like or a polymeric material, including but not limited to those described above, filled with an electrically conducting substance, including but not limited to, carbon, metallic powder, and the like or an organic electrically conducting material. The electrically insulating or conductive substrate can be in the form of an endless flexible belt, a web, a rigid cylinder, a sheet and the like.

The thickness of the substrate layer depends on numerous factors, including desired strength and economical considerations. Thus, for a drum, this layer can be of substantial thickness of, for example, up to many centimeters or of a minimum thickness of less than a millimeter. Similarly, a flexible belt can be of substantial thickness, for example, about 250 micrometers, or of minimum thickness less than about 50 micrometers, provided there are no adverse effects on the final electrophotographic device.

In embodiments where the substrate layer is not conductive, the surface thereof can be rendered electrically conductive by an electrically conductive coating. The conductive coating can vary in thickness over substantially wide ranges depending upon the optical transparency, degree of flexibility desired, and economic factors. Accordingly, for a flexible photoresponsive imaging device, the thickness of the conductive coating can be between about 20 angstroms to about 750 angstroms. The flexible conductive coating can be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer can be applied to the substrate. Any suitable and conventional blocking layer capable of forming an electronic barrier to holes between the adjacent photoconductive layer and the underlying conductive surface of a substrate can be used.

An optional adhesive layer can be applied to the hole blocking layer. Any suitable adhesive layer well known in the art can be used. Typical adhesive layer materials include, for example, polyesters, polyurethanes, and the like. Satisfactory results can be achieved with adhesive layer thickness between about 0.05 micrometer and about 0.3 micrometer. Any suitable conventional technique can be used for applying and drying an adhesive layer.

The electrophotographic imaging member of the present invention also comprises multiple active layers including a charge generator layer and charge transport layer. Charge generator layers can comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers can also comprise inorganic pigments of crystalline selenium and its alloys; Group II-VI compounds; and organic pigments such as quinacridones, polycyclic pigments such as dibromo anthanthrone pigments, perylene and perinone diamines such as benzimidazole perylene, polynuclear aromatic quinones, azo pigments including bis-, tris- and tetrakis-azos, trigonal selenium particles, and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material can be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers can be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80percent by volume of the resinous binder composition. In one embodiment about 8 percent by volume of the photogenerating pigment is dispersed in about 92 percent by volume of the resinous binder composition. The photogenerator layers can also be fabricated by vacuum sublimation in which case there is no binder.

Any suitable and conventional technique can be used to mix and thereafter apply the photogenerating layer coating mixture. Typical application techniques include spraying, dip coating, roll coating, wire wound rod coating, vacuum sublimation and the like. Removal of the solvent of a solvent coated layer can be effected by any suitable conventional technique such as oven drying, infrared radiation drying, air drying and the like.

Two charge transport layers are used in this invention. In other words, the charge transport function in the photoreceptor of this invention is facilitated by two single, preferably contiguous, charge transport layers. Each charge transport layer comprises a hole transporting small molecule, charge transporting polymer, or a mixture of two or more charge transporting molecules, dissolved or molecularly dispersed in a film forming electrically inert polymer such as a polycarbonate.

The term "dissolved" as employed herein is defined as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable hole transporting or electrically active small molecule can be employed in the charge transport layer of this invention.

The expression hole transporting "small molecule" is defined herein as a monomer that allows the free charge photogenerated in the transport layer to be transported across the transport layer. Typical charge transporting small molecules include, but are not limited to, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)1,2,4-oxadiazole, stilbenes and the like. As indicated above, suitable electrically active small molecule hole transporting compounds are dissolved or molecularly dispersed in electrically inactive polymeric film forming materials. A small molecule hole transporting compound that permits injection of holes from the pigment into the charge generating layer with high efficiency and transports them across the charge transport layer with very short transit times includes arylamines such as N,N'diphenyl-N,N'-bis(3-methylphenyl)-(1,1'-biphenyl)-4,4'-diamine, enamines, stilbene substituted arylamines, and the like.

If desired, hole transporting polymers that permit injection of holes from the pigment into the charge generating layer with high efficiency and transports them across the charge transport layer with very short transit times can be used instead of or in addition to the small molecule charge transporting compounds. Typical hole transporting polymers include, but are not limited to, polymeric arylamine compounds and related polymers described in U.S. Pat. Nos. 4,801,517, 4,806,444, 4,818,650, 4,806,443 and 5,030,532, the entire disclosures of which are incorporated herein by reference.

Polyvinylcarbazole and derivatives of Lewis acids are described, for example, in U.S. Pat. No. 4,302,521, the entire disclosure of which is incorporated herein by reference. Electrically active polymers also include, but are not limited to, polysilylenes such as poly(methylphenyl silylene), poly (methylphenyl silylene-co-dimethyl silylene), poly (cyclohexylmethyl silylene), poly(tertiarybutylmethyl silylene), poly(phenylethyl silylene), poly(n-propylmethyl silylene), poly(p-tolylmethyl silylene), poly (cyclotrimethylene silylene), poly(cyclotetramethylene silylene), poly(cyclopentamethylene silylene), poly(di-t-butyl silylene-co-di-methyl silylene), poly(diphenyl silylene-co-phenylnethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717, the entire disclosure of which is incorporated herein by reference. Other polymeric transport materials include, but are not limited to, poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516, the entire disclosure of which is incorporated herein by reference.

Any suitable electrically inactive resin binder can be employed in the charge transport layer of this invention. Typical inactive resin binders include, but are not limited to, polycarbonate resin, polyester, polyarylate, polyacrylate, polyether, polysulfone, and the like. Weight average molecular weights can vary, for example, from about 20,000 to about 150,000. However, molecular weights outside of this range can be employed so long as the objectives of this invention are satisfied. Preferred binders include polycarbonates such as poly(4,4'-isopropylidenediphenylene) carbonate (also referred to as bisphenol-A-polycarbonate, poly(4,4'-cyclohexylidinediphenylene) carbonate (referred to as bisphenol-Z polycarbonate), and the like. Any suitable charge transporting polymer can also be used in the charge transporting layer of this invention. These electrically active charge transporting polymeric materials should be capable of supporting the injection of photogenerated holes from the charge generation material and be incapable of allowing the transport of these holes therethrough. Hole transporting polymers can be used in combination with hole transporting small molecules and/or inert film forming polymer binders. However, hole transporting polymers free of inert film forming polymer binders are preferred.

Any suitable and conventional technique can be used to mix and thereafter apply the two charge transport layers coating mixture to the charge generating layer. Typical application techniques include, for example, spraying, dip coating, roll coating, wire wound rod coating, and the like. Drying of the deposited coating can be effected by any suitable conventional technique such as, for example, oven drying, infra red radiation drying, air drying and the like.

Generally, the thickness of each charge transport layer after drying is between about 5 and about 25 micrometers, therefore, the total thickness of the two charge transport layers are between about 10 and about 50 micrometers, but thicknesses outside this range can also be used. Each transport layer should be an insulator to the extent that the electrostatic charge placed on the hole transport layer is not conducted in the absence of illumination at a rate sufficient to prevent formation and retention of an electrostatic latent image thereon. In general, the ratio of the thicknesses of the transport layers to the charge generator layers is preferably maintained from about 2:1 to 200:1 and in some instances as great as 400:1. The charge transport layers, are substantially non-absorbing to visible light or radiation in the region of intended use but are electrically "active" in that they allow the injection of photogenerated holes from the photoconductive layer, i.e., charge generation layer, and allows these holes to be transported through themselves to selectively discharge a surface charge on the surface of the active layer.

In particular, the imaging member of the present invention comprises a charge transport element that is comprised of a first and a sequentially deposited second charge transport layer. The first charge transport layer exhibits a first charge carrier transit time that differs from a second charge carrier transit time exhibited by the second charge transport layer. In a preferred embodiment of the invention the first charge carrier transit time is greater than the second charge carrier transit time. However, it is possible that the second charge carrier transit time could be greater than the first charge carrier transit time. More specifically, in an exemplary embodiment of the present invention the first charge carrier transit time can be about 50% greater to about 20 times greater than the second charge carrier transit time. For example, a second charge carrier transit time can be from about 2 milliseconds to about 500 milliseconds, and a first charge carrier transit time can be from about 3 milliseconds to about 10 seconds.

The difference in charge carrier transit time between the first charge transport layer and the second charge transport layer can be accomplished in one of two ways. First, each charge transport layer can be comprised of a different charge transport material. In a preferred embodiment of the present invention a charge mobility of a charge transport material for the first charge transport layer is about 4 to 20 times less than a charge mobility of a charge transport material used to make the second charge transport layer.

Alternatively, the first and second charge transport layers can both be comprised of the same charge transport material. In this case, different amounts of the charge transport material can be used to achieve different charge transit times. In a preferred embodiment of the present invention, the first charge transport layer is comprised of an amount of charge transport material that is about 5% to about 30% less than an amount of the charge transport material used to make the second charge transport layer.

Regardless of the method used to fabricate the charge transport element, the imaging member of the present invention exhibits a discharge surface potential at a light exposure that is greater than about 3 erg/cm$^2$, at a post exposure delay of between about 20 milliseconds and about 500 milliseconds that is raised from about 20 to about 200 volts above a discharge potential of an imaging member comprising all of the components of the imaging member of the present invention except having a single charge transport layer with a thickness equal to the thickness of the charge transport element of the present invention.

EXAMPLES

A number of examples are set forth hereinbelow. These examples are merely illustrative of different compositions and conditions that can be used in practicing the present invention. All proportions are by weight unless otherwise indicated. The present invention is in no way limited to the specific compositions and conditions disclosed in the following examples. Further, it will be apparent that the present invention can be practiced with many types of compositions and can have many different uses in accordance with the disclosure above and as pointed out hereinafter.

Example I

Four electrophotographic imaging members are prepared by applying by dip coating a charge blocking layer onto the rough surface of four aluminum drums having a diameter of 30 mm and a length of 34 cm. A zirconium silane blocking layer coating is formed on each drum, the coatings having a thicknesses of 1.3 micrometers after drying. The dried blocking layers are coated with a charge generating layer containing 54 weight percent Type V hydroxy gallium phthalocyanine pigment particles, 46 weight percent VAGF™ film forming polymer (available from Union Carbide) and employing n-butylacetate solvent. VAGF™ being a polymeric reaction product of 81 weight percent vinyl chloride, 4 weight percent vinyl acetate and 15 weight percent hydroxyethyl acrylate having a weight average molecular weight of about 33,000. 6.8 grams of VAGF™ film forming polymer is first dissolved in 119.6 grams of n-butylacetate solvent. After complete dissolution, 8.0 grams of Type V hydroxy gallium phthalocyanine pigment particles are added and ball milled. The resulting mixture of 46 percent by weight VAGF™ and 54 percent by weight hydroxygallium phthalocyanine, based on the total weight of solids, is then diluted with 149.5 grams of n-butylacetate solvent. The coatings are applied at a coating bath withdrawal rate of 200 millimeters/minute. After drying in a forced air oven, the charge generating layers have thicknesses of about 0.3 micrometer.

The four drums are each subsequently coated with two charge transport layers containing the same second charge transport layer but different first charge transport layer. Four coating compositions contain N,N'-diphenyl-N,N'-bis(3-methylphenyl)1,1-biphenyl-4,4'-diamine hole transport molecule and polycarbonate (PCZ400, available from the Mitsubishi Chemical Company) in weight ratios of 40:60, 35:65, 30:70, and 25:75 including 80, 81.6, 83.3, and 84.3 weight percent mixtures of 4 to 1 ratio of tetrahydrofuran (THF) and monochlorobenzene solvent, respectively, and the corresponding rheological properties show a Newtonian behavior at 280, 140, 125, and 123 centipose at nominal shear stresses of 0.1 s-1 to 100 s-1, respectively, are prepared. The first charge transport layers for the four drums are coated by applying the 40:60, 35:65, 30:70, and 25:75 weight ratio mixtures in a Tsukiage dip apparatus at pull rates of 100, 125, 160, and 180 mm/min, respectively. Every second charge transport layer for the four drums (denoted Devices 1–4) is prepared by coating the 40:60 weight ratio mixture in the Tsukiage dip apparatus at a pull rate of 100 mm/min. After drying in a forced air oven for 45 minutes at 120° C., each device has transport layers of similar thicknesses of about 28–30 micrometers.

PIDC curves for the four different photoreceptors are obtained by electrically testing with a cyclic scanner set at a speed of 61 rpm and an exposure light wavelength of 780 nm, wherein the light intensity is incrementally increased with cycling to produce a photoinduced discharge curve from which the photosensitivity is measured. The scanner is equipped with a scrorotron charger set to a surface potential of about 540 volts. The entire xerographic simulation is carried out in an environmentally controlled light tight chamber at ambient conditions. (50 percent RH and 20° C.). The (dV/dX)X=0 for the four different devices are similar at about 250 V/ergs/cm$^2$, and the $E_{0.1}$ and $E_{0.2}$ are similar at about 0.2 and 0.4 ergs/cm$^2$, respectively. The $V_{low}$ for Devices 1–4 however, is raised about 40, 105, 150 and 220 volts, respectively. Five thousand cycles tests at 20° C., 50 percent RH, are also measured for these drums showed no significant variation of the $V_{low}$. No apparent cycle-ups are observed, i.e., no increase of $V_{low}$ (and $V_{residual}$) residual is observed, for these measurements. Excellent cyclic stability is also observed for all four photoreceptors. These results indicate that applying two sequentially deposited charge transport layers with a distinct difference in the composition can vary $V_{low}$ while still maintaining initial photosensitivity and without major modifications to charge transport layer formulations and coating conditions.

Example II

The procedures of Example I are repeated except that chlorogallium phthalocyanine particles and VMCH™ (available from Union Carbide) are substituted for the Type V hydroxy gallium phthalocyanine particles and VAGF™, respectively. The initial and low exposure photosensitivities, $(dV/dX)_{X=0}$, $E_{0.1}$, and $E_{0.2}$, for the four different devices are similar at about 175 V/ergs/cm$^2$, 0.30 and 0.58 ergs/cm$^2$, respectively, and $V_{low}$ of the PIDC curves are raised from about 70 to 210, 290, and 380 volts with respect to four coating compositions containing N,N-diphenyl-N,N'bis(3-methylphenyl)-1,1-biphenyl-4,4'-diamine hole transport molecule and polycarbonate in weight ratios of 40:60, 35:65, 30:70 and 25:75, including 80, 81.6, 83.3 and 84.3 weight percent mixtures of a 4 to 1 ratio of tetrahydrofuran and monochlorobenzene. Five thousand cycles tests at 20° C., 50 percent RH, are also measured for these drums and no apparent cycle-ups are observed, i.e., no increase of $V_{residual}$ is observed, for these measurements. Excellent cyclic stability is also observed for all four photoreceptors. These results further indicate that applying two sequentially deposited charge transport layers with a distinct difference in the compositions can vary $V_{low}$ while still maintaining initial photosensitivity and without major modifications to charge transport layer formulations and coating conditions.

Example III

Four electrophotographic imaging members are prepared by applying by dip coating a charge blocking layer onto the rough surface of four aluminum drums having a diameter of 30 mm and a length of 34 cm. A zirconium blocking layer coating is formed on each drum, the coatings having a thickness of 1.3 micrometers after drying. The dried blocking layers are coated with a charge generating layer containing 54 weight percent Type V hydroxy gallium phthalocyanine pigment particles, 46 weight percent VAGF™ film forming polymer (available from Union Carbide) and employing n-butylacetate solvent. VAGF™ being a polymeric reaction product of 81 weight percent vinyl chloride, 4 weight percent vinyl acetate and 15 weight percent hydroxyethyl acrylate having a weight average molecular weight of about 33,000. 6.8 grams of VAGF™ film forming polymer is first dissolved in 119.6 grams of n-butylacetate solvent. After complete dissolution, 8.0 grams of Type V hydroxy gallium phthalocyanine pigment particles are added and ball milled. The resulting mixture of 46 percent by weight VAGF™ and 54 percent by weight hydroxygallium phthalocyanine, based on the total weight of solids, is then diluted with 149.5 grams of n-butylacetate solvent. The coatings are applied at a coating bath withdrawal rate of 200 millimeters/minute. After drying in a forced air oven, the charge generating layers have thicknesses of about 0.3 micrometer.

The four drums are each subsequently coated with two charge transport layers containing the same second charge transport layer but different first charge transport layer. Four coating compositions containing polyvinylcarbozole hole transport molecule and polycarbonate (PCZ400, available from the Mitsubishi Chemical Company) in weight ratios of 40:60, 35:65, 30:70, and 25:75 including 80, 81.6, 83.3, and 84.3 weight percent mixtures of 4 to 1 ratio of tetrahydrofuran (THF) and monochlorobenzene (MCB) solvent, respectively are prepared. The first charge transport layers for the four drums are coated by applying the 40:60, 35:65, 30:70, and 25:75 weight ratio mixtures in a Tsukiage dip apparatus at pull rates of 100, 125, 160, and 180 mm/min, respectively. Every second charge transport layer for the four drums (denoted Devices 1–4) is prepared in accordance with the procedures set forth in Example I.

PIDC curves for the four different photoreceptors are obtained by electrically testing with a cyclic scanner set at a speed of 61 rpm and an exposure light wavelength of 780 nm, wherein the light intensity is incrementally increased with cycling to produce a photoinduced discharge curve from which the photosensitivity is measured. The scanner is equipped with a scrorotron charger set to a surface potential of about 540 volts. The entire xerographic simulation is carried out in an environmentally controlled light tight chamber at ambient conditions. (50 percent RH and 20° C.). The (dV/dX)X=0 for the four different devices are similar at about 250 V/ergs/cm$^2$, and the $E_{0.1}$ and $E_{0.2}$ are similar at about 0.2 and 0.4 ergs/cm$^2$, respectively. The $V_{low}$ for Devices 1–4 however, is significantly raised. Variable cycle tests at ambient temperature and RH, are also measured for these drums showed no significant variation of the $V_{low}$. No apparent cycle-ups are observed, i.e., no increase of $V_{low}$ (and $V_{residual}$) residual is observed, for these measurements. Excellent cyclic stability is also observed for all four photoreceptors. These results indicate that applying two sequentially deposited charge transport layers with a distinct difference in the composition can vary $V_{low}$ while still maintaining initial photosensitivity and without major modifications to charge transport layer formulations and coating conditions.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A tunable electrophotographic imaging member comprising:

a substrate;

an optional charge blocking layer;

an optional adhesive layer;

a charge generating layer;

a charge transport element comprising a first charge transport layer and a sequentially deposited second charge transport layer;

wherein each of the first and second charge transport layers comprises a hole transport material and optionally a film forming binder;

wherein the first charge transport layer exhibits a first charge carrier transit time and the second charge transport layer exhibits a second charge carrier transit time;

wherein either:

(1) a different charge transport material is used for each of the first and second charge transport layers so that a charge mobility of the charge transport material of the first charge transport layer is about 4 to about 20 times less than a charge mobility of the charge transport material of the second charge transport layer; or (2) both the first and second charge transport layers are comprised of the same charge transport material and the first charge transport layer is comprised of an amount of charge transport material that is about 5% to about 30% less than an amount of charge transport material comprised by the second charge transport layer; and wherein a discharge surface potential of the imaging member at a light exposure greater than about 3 erg/cm$^2$ at a post exposure delay of between about 20 milliseconds and about 500 milliseconds is raised from about 20 to about 200 volts above a discharge potential of an imaging member comprising each of the above components except having a single charge transport layer with a thickness that is equivalent to said charge transporting element.

2. The imaging member of claim 1, wherein an ionization potential of a hole transport material of said second charge transport layer is less than or equal to an ionization potential of a hole transport material of said first charge transport layer.

3. The imaging member of claim 1, wherein said charge transporting element is between about 5 micrometers and about 50 micrometers thick.

4. The imaging member of claim 1, wherein said first and said second charge transport layers each comprise a hole transporting small molecule that is at least one of dissolved or molecularly dispersed in a film forming and electrically inert polymer.

5. The imaging member of claim 4, wherein said hole transporting small molecule is selected from the group consisting of 1-phenyl-3-(4'-diethylamino styryl)-5-(4"-diethylamino phenyl)pyrazoline, N,N'-diphenyl-N,N'-bis(3-methylphenyl)-(1,1'-biphenyl)-4,4'-diamine, N-phenyl-N-methyl-3-(9-ethyl)carbazyl hydrazone, 4-diethyl amino benzaldehyde-1,2-diphenyl hydrazone, and 2,5-bis (4-N,N'-diethylarainophenyl)-1,2,4-oxadiazole.

6. The imaging member of claim 1, wherein said first charge carrier transit time is greater than said second charge carrier transit time.

7. A method of fabricating the imaging member of claim 1, the method comprising:

providing a substrate;

providing a charge generating layer upon said substrate;

sequentially depositing a first charge transport layer and a second charge transport layer upon said charge generating layer to form a charge transport element;

wherein each of the first and second charge transport layer comprises a hole transport material and optionally a film forming binder;

wherein the first charge transport layer exhibits a first charge carrier transit time and the second charge transport layer exhibits a second charge carrier transit time; and wherein either:

(1) using a different charge transport material to form each of the first and second charge transport layers so that a charge mobility of a charge transport material of said first charge transport layer is about 4 to about 20 times lower than a charge mobility of a charge transport material of said second charge transport layer; or (2) using the same charge transport material for both the first and second charge transport layer, but using about 5% to about 30% less charge transport material to form said first charge transport layer than to form said second charge transport layer, so that a discharge surface potential of the imaging member at a light exposure greater than about 3 erg/cm$^2$ at a post exposure delay of between about 20 milliseconds and about 500 milliseconds is raised from about 20 to about 200 volts above a discharge potential of an imaging member comprising each of the above components except having a only single charge transport layer with a thickness that is equivalent to a thickness of said charge transporting element.

8. The method of claim 7, further comprising configuring said charge transporting element so that said charge transporting element is between about 5 micrometers and about 50 micrometers thick.

9. The method of claim 7, further comprising selecting a hole transport material for said second charge transport layer having an ionization potential that is less than or equal to an ionization potential of a hole transport material selected for said first charge transport layer.

10. The method of claim 7, wherein said first charge carrier transit time is about 50% greater than said second charge carrier transit time.

11. The method of claim 7, wherein said first charge carrier transit time is about 10 times greater than said second charge carrier transit time.

12. An electrophotographic imaging process using the imaging member of claim 1, the process comprising:

a) providing an electrophotograhic imaging member comprising a substrate; an optional charge blocking layer; an optional adhesive layer; a charge generating layer; a charge transport element comprising a first charge transport layer and a sequentially deposited second charge transport layers; wherein each of the first and second charge transport layers comprises a hole transport material and optionally a film forming binder; wherein the first charge transport layer exhibits a first charge carrier transit time and the second charge transport layer exhibits a second charge carrier transit time; wherein either:

(1) a different charge transport material is used for each of the first and second charge transport layer so that the charge mobility of the charge transport material of the first charge transport layer is about 4 to about 20 times lower than the charge mobility of the charge transport material of the second charge transport layer; or (2) both the first and second charge transport layers are comprised of the same charge transport material and the first charge transport layer is comprised of an amount of the charge transport material that is about 5% to about 30% less than an amount of charge transport material comprised by the second charge transport layer;

and wherein a discharge surface potential of the imaging member at a light exposure greater than about 3 erg/cm$^2$ at a post exposure delay of between about 20 millisecond and about 500 milliseconds is raised from about 20 to about 200 volts above a discharge potential of an imaging member comprising each of the above components except having a single charge transport layer with a thickness that is equivalent to said charge transporting element;

b) depositing a uniform electrostatic charge on said imaging member;

c) exposing said imaging member to activating radiation in an image configuration to form an electrostatic latent image on said imaging member;

d) developing said electrostatic latent image with electrically attractable marking particles to form a toner image;

e) transferring said toner image to a receiving member;

f) cleaning said imaging member; and g) repeating said depositing, exposing, developing, transferring and cleaning steps.

* * * * *